US012768620B2

(12) United States Patent
Liang et al.

(10) Patent No.: US 12,768,620 B2
(45) Date of Patent: Oct. 20, 2026

(54) TELESCOPE RANGE FINDER BASED ON THERMAL IMAGE-WIND SPEED-NOISE AND RANGING METHOD THEREOF

(71) Applicant: SNDWAY TECHNOLOGY (GUANGDONG) CO., LTD., Dongguan (CN)

(72) Inventors: Wu Liang, Dongguan (CN); Gang He, Dongguan (CN)

(73) Assignee: SNDWAY TECHNOLOGY (GUANGDONG) CO., LTD., Dongguan (CN)

( * ) Notice: Subject to any disclaimer, the term of this patent is extended or adjusted under 35 U.S.C. 154(b) by 545 days.

(21) Appl. No.: 18/465,175

(22) Filed: Sep. 12, 2023

(65) Prior Publication Data

US 2024/0183638 A1 Jun. 6, 2024

(30) Foreign Application Priority Data

Dec. 2, 2022 (CN) ..... 202211537449.2

(51) Int. Cl.

| | |
|---|---|
| ***F41G 3/08*** | (2006.01) |
| ***F41G 3/06*** | (2006.01) |
| ***F41G 3/16*** | (2006.01) |

(52) U.S. Cl.

CPC ..... *F41G 3/08* (2013.01); *F41G 3/06* (2013.01); *F41G 3/165* (2013.01)

(58) Field of Classification Search

CPC ... F41G 3/08; F41G 3/06; F41G 3/165; G01S 17/08; G01S 17/86; G01S 17/10; Y02A 90/10; A63B 69/3658; A63B 2220/20; A63B 2220/76; G01P 5/10

See application file for complete search history.

(56) References Cited

U.S. PATENT DOCUMENTS

| | | | | |
|---|---|---|---|---|
| 2010/0220309 | A1* | 9/2010 | Zhu | G01S 7/48 356/4.01 |
| 2011/0164783 | A1* | 7/2011 | Hays | G01S 17/003 356/519 |
| 2012/0169053 | A1* | 7/2012 | Tchoryk, Jr. | G01S 7/491 356/28 |
| 2021/0262761 | A1* | 8/2021 | Hamilton | F41G 3/08 |
| 2022/0187448 | A1* | 6/2022 | Shand | G01S 13/931 |
| 2022/0194383 | A1* | 6/2022 | Tabata | G07C 5/0833 |

(Continued)

*Primary Examiner* — Md Saiful A Siddiqui

(57) ABSTRACT

Provided is a telescope range finder based on thermal image-wind speed-noise, which includes a range finder body, a wind speed measuring device, a noise measuring device, and a thermal image display device. The range finder body includes a processor. The wind speed measuring device includes a wind wheel, the wind wheel is connected to a tachometer, and the tachometer is connected to the processor. The noise measuring device includes a microphone, and the microphone is connected to an amplification-filtering-rectification circuit. The amplification-filtering-rectification circuit is connected to the processor. The microphone is configured to convert a noise into an electrical signal for entering the processor through the amplification-filtering-rectification circuit. The thermal image display device includes a thermal image sensor. The thermal image sensor is disposed in the range finder body. The thermal image sensor is connected to a display through the processor.

18 Claims, 2 Drawing Sheets

(56) References Cited

U.S. PATENT DOCUMENTS

| | | | | |
|---|---|---|---|---|
| 2024/0060747 | A1* | 2/2024 | Hamilton | F41G 3/065 |
| 2024/0184092 | A1* | 6/2024 | Masarik | F41G 1/30 |
| 2024/0427023 | A1* | 12/2024 | Nguyen | G01S 17/006 |

* cited by examiner

TELESCOPE RANGE FINDER BASED ON THERMAL IMAGE-WIND SPEED-NOISE AND RANGING METHOD THEREOF

TECHNICAL FIELD

The disclosure relates to the field of laser ranging technologies, particularly to a telescope range finder based on thermal image-wind speed-noise and a ranging method thereof.

BACKGROUND

For hunting activities, in a process of hunting at night, because there is no light source, it is difficult to capture a prey, and a traditional telescope range finder needs to rely on an external light source to identify the prey. In addition, in a process of hunting in windy weather, a wind direction and a wind speed will change in real time, which results in a great deviation in a shooting trajectory. In this case, if a hunter relies on his body perception and his own experience to compensate the shooting trajectory, a big error will occur and the wind speed cannot be accurately measured, thereby leading to the loss of the prey. Moreover, in a process of hunting, some preys are aggressive, and the hunter's energy is focused on the prey, so the hunter often ignores the safety of his surrounding environment.

At present, there is no telescope device for trajectory ranging with wind speed compensation function for hunting in the market. In view of this, the disclosure proposes a telescope range finder based on thermal image-wind speed-noise and a ranging method thereof to solve related technical problems.

SUMMARY

With respect to the shortcomings of the related art, objectives of the disclosure are to provide a telescope range finder based on thermal image-wind speed-noise and a ranging method thereof, which are used for solving the problem that due to large shooting error caused by wind in a trajectory in a process of hunting, a targeted prey cannot be hit, and for solving the safety problem of a hunter in the process of hunting.

In order to achieve the above objectives, the disclosure provides the following technical solutions.

A telescope range finder based on thermal image-wind speed-noise is provided, and includes a range finder body. A side of a top portion of the range finder body is provided with a wind speed measuring device, another side of the top portion of the range finder body is provided with a measuring mode component, a front end of the range finder body is provided with a noise measuring device, and a side of the range finder body is provided with a thermal image display device.

The wind speed measuring device includes a frame, gaps are disposed on the frame, a wind wheel is disposed in the frame, the wind wheel is connected to a tachometer, and the tachometer is connected to a processor in the range finder body.

The processor is configured to: in response to rotating of the wind wheel, obtain a wind speed at a current moment according to a formula 1:

$$\text{wind speed} = \text{rotational speed} \times k + b; \quad \text{(formula 1)}$$

where the rotational speed represents data obtained by the tachometer, and k and b represent wind speed calibration parameters;

The noise measuring device includes a microphone, the microphone is connected to an amplification-filtering-rectification circuit, the amplification-filtering-rectification circuit is connected to the processor, the microphone is configured to convert a noise into an electrical signal for entering the processor through the amplification-filtering-rectification circuit, the processor is configured to calculate a noise value of the noise, and a noise alarm value is set in the processor.

The thermal image display device includes a thermal image sensor, the thermal image sensor is disposed in the range finder body, the thermal image sensor is connected to a display through the processor, the display is disposed at the side of the range finder body, and the display is foldably connected to a surface of the range finder body.

Optionally, the range finder body further includes an eyepiece with an eyepiece adjustment thereon, the eyepiece is disposed at the front end of the range finder body, and an objective lens assembly is disposed at a rear end of the range finder body, a top cover is disposed on the range finder body, and the top cover is connected to a housing of the range finder body for sealing.

The range finder body is also provided with a power supply assembly therein, the power supply assembly is configured to supply power to the whole of the telescope range finder, the power supply assembly includes a charging interface, a charging indicator light, a lithium battery charged by the charging interface, and a charging circuit; and the charging interface is configured to charge the lithium battery through the charging circuit.

Optionally, the measurement mode component has a basic distance measurement mode and a shooting compensation distance measurement mode, the measurement mode component includes a power-on measurement button and a mode switching button, the measurement mode component is connected to a time-of-flight (TOF) measurement module, and the TOF measurement module is connected to the processor and the objective lens assembly.

Optionally, the objective lens assembly includes a laser emitting objective lens and a laser receiving objective lens, the TOF measuring module is configured to measure a distance measured by the laser emitting objective lens and the laser receiving objective lens, internal code data of the TOF measuring module is read through the processor, and a target distance is calculated according to a formula 2 based on the internal code data, $$\text{target Distance} = \frac{\text{Internal code data} \times \text{light velocity}}{\text{Full scale value} \times TOF\ \text{frequency} \times 2}. \quad \text{(formula 2)}$$

Optionally, when the shooting compensation distance measurement mode is triggered by a user, a shooting compensation distance is obtained according to a formula 3 expressed as follows:

$$\text{shooting compensation distance} = \text{target distance} \times k \times (\text{wind speed} \times \text{target distance/m}); \quad \text{(formula 3)}$$

where k represents a shooting compensation coefficient, and m represents a proportional coefficient.

A ranging method of the telescope range finder based on thermal image-wind speed-noise described above is provided, which includes:

S1, when the telescope range finder is turned on, initializing, by the processor of the telescope range finder, parameters of the telescope range finder, collecting, by the thermal image sensor, a thermal image in front of the telescope range finder, and displaying the thermal image on the display through the processor;

S2, selecting, by a user, a shooting compensation distance measurement mode or a basic distance measurement mode by triggering a mode switching button, to perform corresponding distance measurement, and to thereby obtain a target distance; and S3, obtaining, by the wind speed measuring device, the wind speed in a current environment, and obtaining a final to-be-measured distance based on the wind speed.

Optionally, the parameters in S1 includes a working mode, a working frequency, a noise filtering parameter of a TOF measuring module, wind speed calibration parameters k and b, and a proportional coefficient m.

Optionally, in S2, a step of obtaining the target distance includes:

sending, by the processor, a measurement instruction to drive a laser emitting objective lens to emit a laser to a to-be-measured target, and to drive a laser receiving objective lens to receive a returned laser from the to-be-measured target; and measuring, by a TOF measuring module, a distance measured by the laser emitting objective lens and the laser receiving objective lens, reading internal code data of the TOF measuring module through the processor, and calculating the target distance based on the internal code data.

Optionally, the obtaining a final to-be-measured distance based on the wind speed in S3 includes:

in a situation that the wind speed in the current environment does not affect a shooting trajectory, taking the target distance as the final to-be-measured distance;

in a situation that the wind speed in the current environment affects the shooting trajectory, calculating a shooting compensation distance based on the wind speed obtained by a wind wheel and the target distance, and taking the shooting compensation distance as the final to-be-measured distance.

Optionally, a screen of the display is configured to: in a situation that the noise value obtained through the electrical signal converted by the microphone is greater than the noise alarm value set by the processor, flash in the current environment based on the thermal image on the display, to prompt a hunter to escape.

Compared with the related art, the disclosure has the following beneficial effects.

(1) In the disclosure, a wind speed at a current moment is accurately calculated through the arrangement of the wind wheel and the tachometer, a real-time distance of the shooting trajectory can be corrected at any time, and shooting times are reduced; and compared with the wind speed sensed by a human body, the wind speed compensation distance measured by the wind wheel driving the tachometer is more stable.

(2) In the disclosure, through the setting of the thermal image sensor, the infrared signal of the prey is obtained and transmitted to the display through the processor for display, so that a range where the prey is located can be monitored in real time, and a detection range of the prey is reduced; and when hunting at night, the hunting can be carried out smoothly without light, and the recognition ability of the prey is strong.

(3) In the disclosure, by setting the noise alarm value through the processor, the noise alarm value is compared with the noise value obtained through processing a noise collected by the microphone, and when the noise value is greater than the noise alarm value, it indicates that the prey is approaching the hunter, and the screen of the display flashes, so that the hunter can be reminded, and in case of danger, the hunter can escape quickly to ensure the safety of the hunter.

(4) In the disclosure, under the condition of ensuring the hunter's safety, the real-time movement of the prey is displayed on the display through the noise measuring device, so that the ability of catching the prey is strong, and the shooting distance is compensated through the wind speed measuring device, so that the hunter can design a better shooting trajectory, which is suitable for any shooting occasion.

DESCRIPTION OF REFERENCE SYMBOLS

Figure 1:
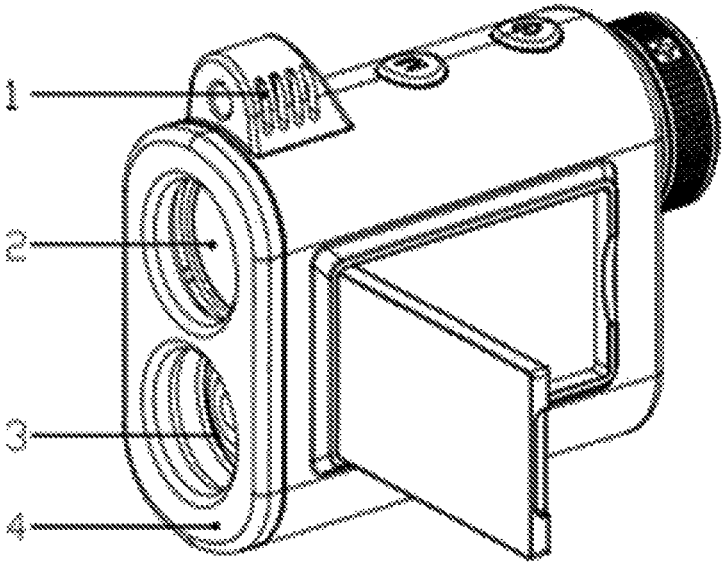
FIG. 1 illustrates a schematic structural view of a telescope range finder based on thermal image-wind speed-noise according to an embodiment of the disclosure.
Figure 2:
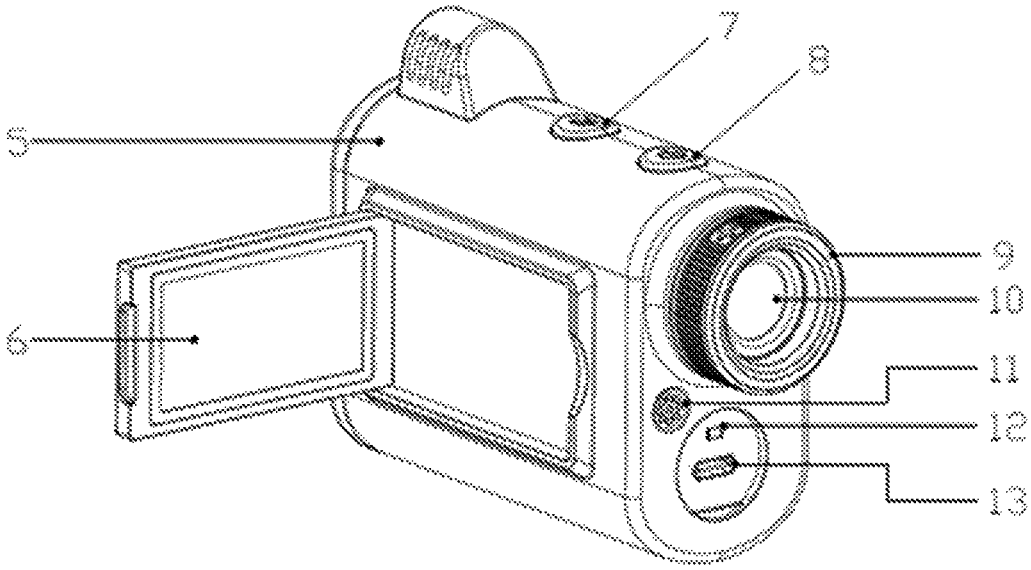
FIG. 2 illustrates a schematic structural view of another telescope range finder based on thermal image-wind speed-noise according to another embodiment of the disclosure.
Figure 3:
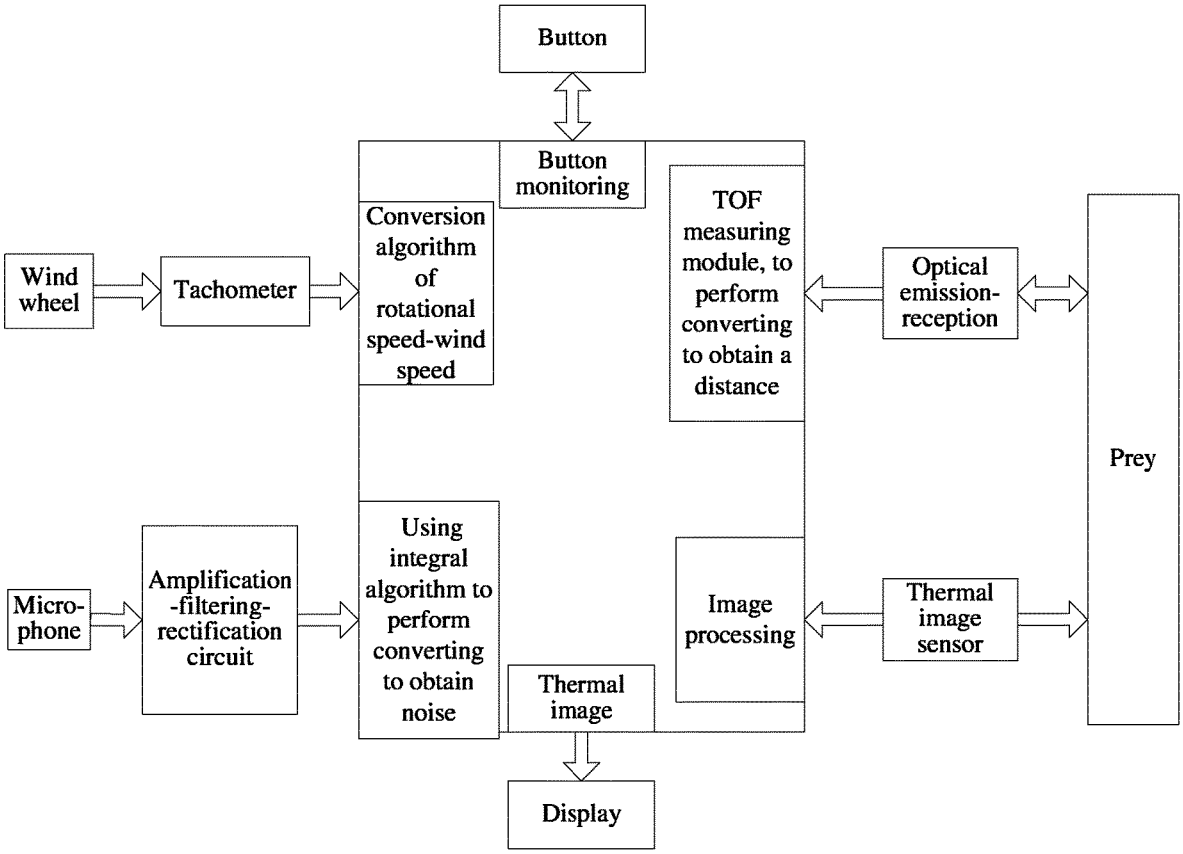
FIG. 3 illustrates a schematic view of an overall design framework of a support loop assembly of a telescope range finder based on thermal image wind-speed-noise according to an embodiment of the disclosure.

1: Wind blade; 2: Laser emitting objective lens; 3: Laser receiving objective lens; 4: Top cover; 5: Housing; 6: Display; 7: Mode switching button; 8: Power-on measurement button; 9: Eyepiece adjustment; 10: Eyepiece; 11: Microphone; 12: Charging indicator light; 13: Charging interface.

DETAILED DESCRIPTION OF EMBODIMENTS

Embodiments of the disclosure will be described hereinafter with reference to accompanying drawings in the specification. It should be understood that the embodiments described here are merely used to illustrate and explain the disclosure, and are not intended to limit the disclosure, and the embodiments in the disclosure and the features in the embodiments can be combined with each other without conflict.

First Embodiment

A first embodiment of the disclosure provides a telescope range finder based on thermal image-wind speed-noise, which includes a range finder body. One side of a top portion of the range finder body is provided with a wind speed measuring device, the other side of the top portion of the range finder body is provided with a measuring mode component, a front end of the range finder body is provided with a noise measuring device, and a side of the range finder body is provided with a thermal image display device.

The wind speed measuring device includes a frame, gaps are disposed on the frame, a wind wheel 1 is disposed in the frame, the wind wheel 1 is connected to a tachometer, and the tachometer is connected to a processor in the range finder body.

The processor is configured to: in response to rotating of the wind wheel 1, obtain a current wind speed according to the following calculation formula 1 expressed as follows:

$$\text{Wind speed} = \text{rotational speed} \times k + b, \quad \text{(formula 1)}$$

where the rotational speed represents data obtained by the tachometer, and k and b represent wind speed calibration parameters;

when 0 V<voltage≤0.6 V, k=11.2 and b=−0.72;

when 0.6 V<voltage≤1.5 V, k=10.3 and b=−0.18;

when voltage>1.5 V, k=9.8 and b=0.57.

The noise measuring device includes a microphone 11, and the microphone 11 is connected to an amplification-filtering-rectification circuit. The amplification-filtering-rectification circuit is connected to the processor. The microphone 11 is configured to convert a noise into an electrical signal for entering the processor through the amplification-filtering-rectification circuit. The processor is configured to calculate a noise value of the noise, and a noise alarm value is set in the processor.

The thermal image display device includes a thermal image sensor, which is arranged in the range finder body. The thermal image sensor is connected to a display 6 through the processor. The display 6 is disposed at the side of the range finder body, and the display 6 is foldably connected to a surface of the range finder body.

A prey radiates an infrared thermal signal, which enter the thermal image sensor through a laser emitting objective lens 2. A thermal image is collected by the thermal image sensor, then the collected thermal image is processed by the processor, and finally displayed on the display 6. When a noise value obtained through calculating of a noise received by the microphone 11 by the processor is greater than the noise alarm value set by the processor, the display 6 flashes to remind the hunter that he in danger and he needs to escape quickly.

In an embodiment, the range finder body also includes an eyepiece 10 with an eyepiece adjustment 9 thereon. The eyepiece 10 is disposed at the front end of the range finder body, and an objective lens assembly is disposed at a rear end of the range finder body. A top cover 4 is disposed on the range finder body, and the top cover 4 is connected to a housing 5 of the range finder body for sealing.

A diopter of the eyepiece 10 can be adjusted through the eyepiece adjustment 9, so that different users can adjust the diopter based on their sights, and can see a distant situation in front clearly. There may be a display screen inside the eyepiece 10, which can display a aimed bull's-eye and measurement data.

The range finder body is also provided with a power supply assembly therein, the power supply assembly is configured to supply power to the whole of the telescope range finder. The power supply assembly includes a charging interface 13, a charging indicator light 12, a lithium battery charged by the charging interface 13 and a charging circuit. The charging interface 13 is configured to charge the lithium battery through the charging circuit.

When charging, a charging cable is connected to the charging interface 13, if the charging indicator light 12 is red, it means that the lithium battery is not fully charged, and if the charging indicator light 12 is green, it means that the lithium battery is fully charged.

In an embodiment, the measurement mode component includes two modes, including a basic distance measurement mode and a shooting compensation distance measurement mode. The measurement mode component includes a power-on measurement button 8 and a mode switching button 7. The measurement mode component is connected to a time-of-flight (TOF) measurement module, and the TOF measurement module is connected to the processor and the objective lens assembly.

The user can select the basic distance measurement mode and the shooting compensation distance measurement mode by short pressing the mode switching button 7, and can enter a setting menu by long pressing the mode switching button 7; and the user can control the telescope range finder to perform distance measurement by pressing the power-on measurement button 8, for one-time distance measurement by short pressing, and for continuous measurement by long pressing the power-on measurement button 8.

In an embodiment, the objective lens assembly includes a laser emitting objective lens 2 and a laser receiving objective lens 3, and the TOF measuring module is configured to measure a distance measured by the laser emitting objective lens 2 and the laser receiving objective lens 3, internal code data of the TOF measuring module is read through the processor, and a target distance is calculated according to a formula 2 based on the internal code data;

$$\text{Target Distance} = \frac{\text{Internal code} \times \text{light velocity}}{\text{Full scale value} \times TOF\ \text{frequency} \times 2}. \quad \text{(formula 2)}$$

When the processor sends out a measurement instruction, the measurement instruction excites the laser transmitting objective lens 2 to emit a laser to a prey, the laser is reflected and the reflected laser is received by the laser receiving objective lens 3, and then the TOF measurement module performs measuring to obtain the distance.

In an embodiment, when the shooting compensation distance measurement mode is triggered by a user, a shooting compensation distance is obtained according to a formula 3 expressed as follows:

$$\text{shooting compensation distance} = \text{target distance} \times k \times (\text{wind speed} \times \text{target distance/m}), \quad \text{(formula 3)}$$

where k represents a shooting compensation coefficient, and m represent a proportional coefficient;

when target distance≤50 m, k=1.0 and m=2506;

when 50 m<target distance<target distance≤200 m, k=1.06, and m=8480;

when 200 m<target distance<target distance≤500 m, k=1.12, and m=28,000;

when target distance>500 m, k=1.21, and m=61256.25.

Second Embodiment

The second embodiment of the disclosure provides a ranging method of the telescope range finder based on thermal image-wind speed-noise described in the first embodiment, which includes the following steps:

S1, when the telescope range finder is turned on, initializing, by the processor of the telescope range finder, parameters of the telescope range finder, and collecting, by the thermal image sensor, a thermal image in front of the telescope range finder, and displaying the thermal image on the display 6 through the processor;

S2, selecting, by a user, a shooting compensation distance measurement mode or a basic distance measurement mode by triggering a mode switching button, to perform corresponding distance measurement, and to thereby obtain a target distance; and S3, obtaining, by the wind speed measuring device, the wind speed in a current environment, and obtaining a final to-be-measured distance based on the wind speed.

In an embodiment, the parameters in S1 includes a working mode, a working frequency, a noise filtering parameter of a TOF measuring module, wind speed calibration parameters k and b, and a proportional coefficient m.

In an embodiment, in S2, a step of obtaining the target distance includes:

sending, by the processor, a measurement instruction to drive a laser emitting objective lens 2 to emit a laser to a to-be-measured target, and to drive a laser receiving objective lens 3 to receive a returned laser from the to-be-measured target; and measuring, by a TOF measuring module, a distance measured by the laser emitting objective lens 2 and the laser receiving objective lens 3, reading internal code data of the TOF measuring module through the processor, and calculating the target distance based on the internal code data.

In an embodiment, the obtaining a final to-be-measured distance based on the wind speed in S3 includes:

in a situation that the wind speed in the current environment does not affect a shooting trajectory, taking the obtained target distance as the final to-be-measured distance;

in a situation that the wind speed in the current environment affects the shooting trajectory, calculating a shooting compensation distance based on the wind speed obtained by a wind wheel 1 and the target distance, and taking the shooting compensation distance as the final to-be-measured distance.

In an embodiment, a screen of the display 6 is configured to: in a situation that the noise value obtained through the electrical signal converted by the microphone 11 is greater than the noise alarm value set by the processor, flash in the current environment based on the thermal image on the display 6, to prompt a hunter to escape.

Basic concepts have been described above, and it is apparent that for those skilled in the art, the above detailed disclosure is merely exemplary, and does not constitute a limitation of this specification. Although it is not explicitly stated herein, those skilled in the art may make various modifications, improvements and offset treatments to the specification. Such modifications, improvements and offset treatments are suggested in this specification, and such modifications, improvements and offset treatments still belong to the spirit and scope of the exemplary embodiments of this specification.

In addition, those skilled in the art can understand that various aspects of this specification can be illustrated and described by several patentable categories or situations, including any novel and useful process, machine, product or substance combination, or any novel and useful improvement thereof. Accordingly, various aspects of this specification can be completely executed by hardware, completely executed by software including firmware, resident software, and microcode, or executed by a combination of hardware and software. All the above hardware or software can be called "block", "module", "engine", "unit", "component" or "system". Furthermore, aspects of this specification may be embodied as a computer product in one or more computer-readable media, which includes computer-readable program code.

It should be noted that in case of any inconsistency or conflict between the descriptions, definitions and/or terms used in the attached materials of this specification and those described in this specification, the descriptions, definitions and/or terms used in this specification shall prevail.

Finally, it should be understood that the embodiments described in this specification are merely used to illustrate the principles of the embodiments in this specification. Other variations may also fall within the scope of this specification. Therefore, by way of example and not limitation, alternative configurations of embodiments of this specification can be regarded as consistent with the teachings of this specification. Accordingly, the embodiments in this specification are not limited to the implementations explicitly introduced and described in this specification.

What is claimed is:

1. A telescope range finder based on thermal image-wind speed-noise, comprising a range finder body, wherein a side of a top portion of the range finder body is provided with a wind speed measuring device, another side of the top portion of the range finder body is provided with a measurement mode component, a front end of the range finder body is provided with a noise measuring device, and a side of the range finder body is provided with a thermal image display device;

wherein the wind speed measuring device comprises a frame, gaps are disposed on the frame, a wind wheel is disposed in the frame, the wind wheel is connected to a tachometer, and the tachometer is connected to a processor in the range finder body;

wherein the processor is configured to: in response to rotating of the wind wheel, obtain a wind speed at a current moment according to a formula 1 expressed as follows:

$$\text{wind speed} = \text{rotational speed} \times k + b; \quad \text{(formula 1)}$$

where the rotational speed represents data obtained by the tachometer, and k and b represent wind speed calibration parameters;

wherein the noise measuring device comprises a microphone, the microphone is connected to an amplification-filtering-rectification circuit, the amplification-filtering-rectification circuit is connected to the processor, the microphone is configured to convert a noise into an electrical signal for entering the processor through the amplification-filtering-rectification circuit, the processor is configured to calculate a noise value of the noise, and a noise alarm value is set in the processor; and wherein the thermal image display device comprises a thermal image sensor, the thermal image sensor is disposed in the range finder body, the thermal image sensor is connected to a display through the processor, the display is disposed at the side of the range finder body, and the display is foldably connected to a surface of the range finder body.

2. The telescope range finder based on thermal image-wind speed-noise as claimed in claim 1, wherein the range finder body further comprises an eyepiece with an eyepiece adjustment thereon, the eyepiece is disposed at the front end of the range finder body, and an objective lens assembly is disposed at a rear end of the range finder body, a top cover is disposed on the range finder body, and the top cover is connected to a housing of the range finder body for sealing;

wherein the range finder body is also provided with a power supply assembly therein, the power supply assembly is configured to supply power to the whole of the telescope range finder, the power supply assembly comprises a charging interface and a charging indicator light.

3. The telescope range finder based on thermal image-wind speed-noise as claimed in claim 2, wherein the measurement mode component has a basic distance measurement mode and a shooting compensation distance measurement mode, the measurement mode component comprises a power-on measurement button and a mode switching button, the measurement mode component is connected to a time-of-flight (TOF) measuring module, and the TOF measuring module is connected to the processor and the objective lens assembly.

4. The telescope range finder based on thermal image-wind speed-noise as claimed in claim 3, wherein when the shooting compensation distance measurement mode is triggered by a user, a shooting compensation distance is obtained according to a formula 3 expressed as follows:

$$\text{shooting compensation distance} = \text{target distance} \times k \times (\text{wind speed} \times \text{target distance/m}), \quad \text{(formula 3)}$$

where k represents a shooting compensation coefficient, and m represents a proportional coefficient.

5. The telescope range finder based on thermal image-wind speed-noise as claimed in claim 4, wherein when target distance≤50 m, k=1.0 and m=2506;

when 50 m<target distance≤200 m, k=1.06, and m=8480;

when 200 m<target distance≤500 m, k=1.12, and m=28,000; and when target distance>500 m, k=1.21, and m=61256.25.

6. The telescope range finder based on thermal image-wind speed-noise as claimed in claim 2, wherein the objective lens assembly comprises a laser emitting objective lens and a laser receiving objective lens, the TOF measuring module is configured to measure a distance measured by the laser emitting objective lens and the laser receiving objective lens, internal code data of the TOF measuring module is read through the processor, and a target distance is calculated according to a formula 2 based on the internal code data, $$\text{Target Distance} = \frac{\text{Internal code data} \times \text{light velocity}}{\text{Full scale value} \times TOF\ \text{frequency} \times 2}. \quad \text{(formula 2)}$$

7. A ranging method, implemented by a telescope range finder based on thermal image-wind speed-noise, wherein the telescope range finder comprises a processor, a thermal image sensor, a display, a mode switching button, and a wind speed measuring device, and the ranging method comprises:

S1, when the telescope range finder is turned on, initializing, by the processor of the telescope range finder, parameters of the telescope range finder, collecting, by the thermal image sensor, a thermal image in front of the telescope range finder, and displaying the thermal image on the display through the processor;

S2, in response to the mode switching button being triggered to trigger a shooting compensation distance measurement mode or a basic distance measurement mode, performing corresponding distance measurement to obtain a target distance; and S3, obtaining, by the wind speed measuring device, the wind speed in a current environment, and obtaining a final to-be-measured distance based on the wind speed;

wherein the telescope range finder comprises a laser emitting objective lens, a TOF measuring module, and a laser receiving objective lens; and wherein in S2, a step of obtaining the target distance comprises:

sending, by the processor, a measurement instruction to drive the laser emitting objective lens to emit a laser to a to-be-measured target, and to drive the laser receiving objective lens to receive a returned laser from the to-be-measured target; and measuring, by the TOF measuring module, a distance measured by the laser emitting objective lens and the laser receiving objective lens, reading internal code data of the TOF measuring module through the processor, and calculating the target distance based on the internal code data.

8. The ranging method as claimed in claim 7, wherein the parameters of the telescope range finder comprise a working mode of the TOF measuring module, a working frequency of the TOF measuring module, a noise filtering parameter of the TOF measuring module, wind speed calibration parameters k and b, and a proportional coefficient m.

9. The ranging method as claimed in claim 7, wherein the obtaining a final to-be-measured distance based on the wind speed in S3 comprises:

in a situation that the wind speed in the current environment does not affect a shooting trajectory, taking the target distance as the final to-be-measured distance; and in a situation that the wind speed in the current environment affects the shooting trajectory, calculating a shooting compensation distance based on the wind speed obtained by a wind wheel of the telescope range finder and the target distance, and taking the shooting compensation distance as the final to-be-measured distance.

10. The ranging method as claimed in claim 9, wherein the shooting compensation distance is calculated by a formula expressed as follows:

$$\text{shooting compensation distance} = \text{target distance} \times k \times (\text{wind speed} \times \text{target distance/m}),$$

where k represents a shooting compensation coefficient, and m represents a proportional coefficient.

11. The ranging method as claimed in claim 7, further comprising:

in a situation that a noise value obtained through an electrical signal converted by a microphone of the telescope range finder is greater than a noise alarm value set by the processor, controlling, by the processor, a screen of the display to flash for prompting.

12. The ranging method as claimed in claim 7, wherein the target distance is calculated by a formula expressed as follows:

$$\text{Target Distance} = (\text{Internal code data} \times \text{light velocity}) / (\text{Full scale value} \times TOF \text{ frequency} \times 2).$$

13. A telescope range finder based on thermal image-wind speed-noise, comprising a processor, a TOF measuring device, and a wind speed measuring device;

wherein each of the TOF measuring device and the wind speed measuring device is connected to the processor;

wherein the TOF measuring device is configured to perform distance measurement to obtain a target distance between the telescope range finder and a target;

wherein the wind speed measuring device is configured to obtain a wind speed in a current environment;

wherein the processor is configured to determine a final to-be-measured distance between the telescope range finder and the target based on the target distance and the wind speed, wherein the final to-be-measured distance is configured for designing a shooting trajectory of the target; and wherein the processor is further configured to:

in a situation that the wind speed in the current environment does not affect the shooting trajectory, take the target distance as the final to-be-measured distance;

in a situation that the wind speed in the current environment affects the shooting trajectory, calculate a shooting compensation distance based on the wind speed obtained by a wind wheel and the target distance, and take the shooting compensation distance as the final to-be-measured distance.

14. The telescope range finder based on thermal image-wind speed-noise as claimed in claim 13, further comprising a thermal image sensor and a display, and each of the thermal image sensor and the display is connected to the processor;

wherein the thermal image sensor is configured to collect a thermal image of the target; and wherein the display is configured to display the thermal image of the target.

15. The telescope range finder based on thermal image-wind speed-noise as claimed in claim 14, further comprising a microphone connected to the processor;

wherein the microphone is configured to obtain a noise in the current environment;

wherein the processor is configured to:

determine a noise value of the noise, compare the noise value with the noise alarm value; and in response to determining the noise value being greater than the noise alarm value, control a screen of the display to flash for prompting.

16. The telescope range finder based on thermal image-wind speed-noise as claimed in claim 13, further comprising a laser emitting objective lens and a laser receiving objective lens;

wherein the TOF measuring module is connected to the laser emitting objective lens and the laser receiving objective lens;

wherein the TOF measuring module is configured to measure a distance measured by the laser emitting objective lens and the laser receiving objective lens wherein the processor is configured to read internal code data of the TOF measuring module; and wherein the target distance is calculated by a formula expressed as follows:

$$\text{Target Distance} = \frac{\text{Internal code data} \times \text{light velocity}}{\text{Full scale value} \times TOF \text{ frequency} \times 2}.$$

17. The telescope range finder based on thermal image-wind speed-noise as claimed in claim 13, wherein the shooting compensation distance is calculated by a formula expressed as follows:

$$\text{shooting compensation distance} = \text{target distance} \times k \times (\text{wind speed} \times \text{target distance/m}),$$

where k represents a shooting compensation coefficient, and m represents a proportional coefficient.

18. The telescope range finder based on thermal image-wind speed-noise as claimed in claim 17, wherein when target distance≤50 m, k=1.0 and m=2506;

when 50 m<target distance≤200 m, k=1.06, and m=8480;

when 200 m<target distance≤500 m, k=1.12, and m=28,000; and when target distance>500 m, k=1.21, and m=61256.25.

* * * * *